US006523944B1

(12) United States Patent
Roy et al.

(10) Patent No.: US 6,523,944 B1
(45) Date of Patent: Feb. 25, 2003

(54) INK DELIVERY SYSTEM FOR ACOUSTIC INK PRINTING APPLICATIONS

(75) Inventors: Joy Roy, San Jose, CA (US); Daniel Chi Zhang, Milpitas, CA (US); Stephen David White, Santa Clara, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/343,297

(22) Filed: Jun. 30, 1999

(51) Int. Cl.[7] ..... B41J 2/175
(52) U.S. Cl. ..... 347/85
(58) Field of Search ..... 347/85, 86, 87, 347/89, 93, 18, 92

(56) References Cited

U.S. PATENT DOCUMENTS

| | | | | |
|---|---|---|---|---|
| 3,999,190 A | * | 12/1976 | Brown et al. | 347/85 X |
| 4,106,030 A | | 8/1978 | Hampton et al. | 346/140 R |
| 4,153,902 A | * | 5/1979 | Kanayama | 347/93 X |
| 4,263,139 A | * | 4/1981 | Erlich | 210/169 |
| 4,308,547 A | | 12/1981 | Lovelady et al. | |
| 4,340,895 A | * | 7/1982 | Kikuchi | 347/92 |
| 4,340,896 A | * | 7/1982 | Cruz-Uribe et al. | 347/85 |
| 4,564,749 A | | 1/1986 | Ishima | 219/497 |
| 4,590,362 A | | 5/1986 | Ishima | 219/497 |
| 4,697,195 A | | 9/1987 | Quate et al. | |
| 4,751,530 A | | 6/1988 | Elrod et al. | |
| 4,751,534 A | | 6/1988 | Elrod et al. | |
| 5,028,937 A | | 7/1991 | Khuri-Yakub et al. | |
| 5,041,849 A | | 8/1991 | Quate et al. | |
| 5,289,211 A | * | 2/1994 | Morandotti et al. | 347/86 X |
| 5,341,162 A | * | 8/1994 | Hermanson et al. | 347/92 |
| 5,481,289 A | * | 1/1996 | Arachima et al. | 347/93 |
| 5,489,925 A | * | 2/1996 | Brooks et al. | 347/85 X |
| 5,540,569 A | * | 7/1996 | Altham et al. | 347/85 X |
| 5,621,444 A | * | 4/1997 | Beeson | 347/88 |
| 5,782,604 A | * | 7/1998 | Luxford | 347/85 X |
| 5,793,395 A | * | 8/1998 | Tanaka et al. | 347/85 |

FOREIGN PATENT DOCUMENTS

| | | | | |
|---|---|---|---|---|
| EP | 0 480 302 A1 | * | 4/1992 | 347/86 |
| JP | 56-44664 A | * | 4/1981 | 347/18 |

* cited by examiner

*Primary Examiner*—Thinh Nguyen
(74) *Attorney, Agent, or Firm*—Fay, Sharpe, Fagan, Minnich & McKee, LLP

(57) ABSTRACT

An ink delivery system for acoustic ink printheads is provided. The relatively compact sealless system provides a high speed, pulseless and uniform flows of ink through the acoustic ink printheads. The system includes a single motor, a multi-head pump, multiple ink reservoirs with ink filters, and ink level sensing means. The system also includes a mechanism for maintaining ink pressure in the printhead independent of the volume of ink in the reservoir, the amount of filter blockage, or the absolute ambient pressure. As an option, the system also includes a segmented manifold for the printhead to deliver, for example, multiple colors of ink to a single printhead.

17 Claims, 6 Drawing Sheets

FIG.6(a)
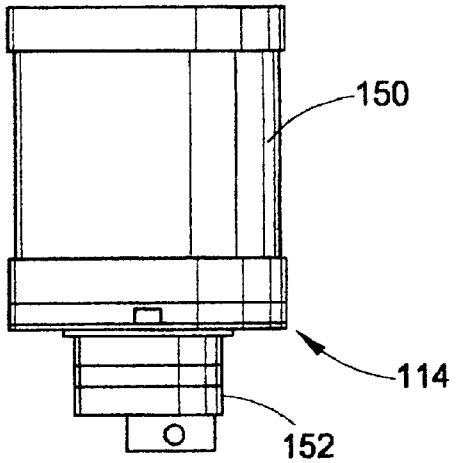
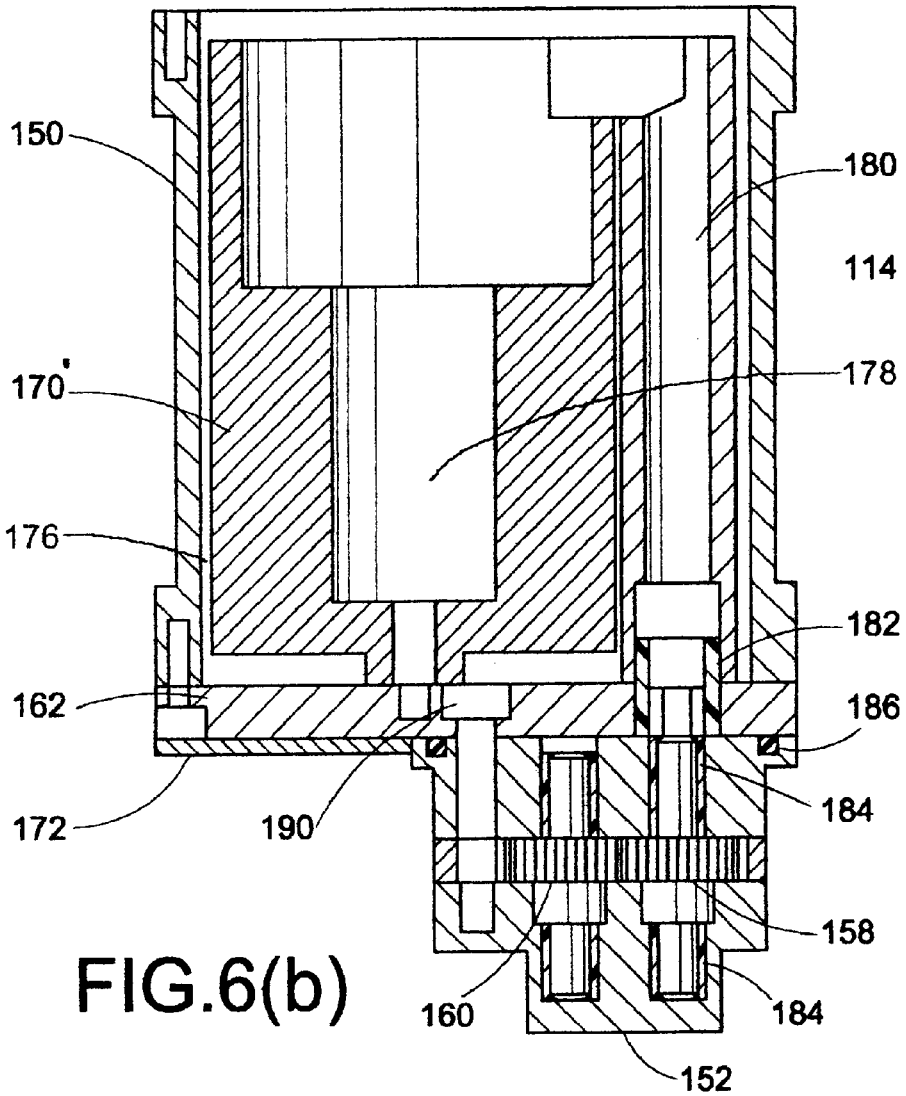
FIG.6(b)

INK DELIVERY SYSTEM FOR ACOUSTIC INK PRINTING APPLICATIONS

BACKGROUND OF THE INVENTION

Field of the Invention

This invention relates to an ink delivery system for acoustic ink printing applications utilizing an acoustic ink printhead having droplet emitters aligned with orifices. More particularly, the invention is directed to a relatively compact, sealless system that provides high speed, pulseless and uniform flows of ink through multiple acoustic ink printheads. The system enables the correct positioning of the meniscus at every orifice of each of the different printheads by passively maintaining the ink pressure in each of the printheads independent of the ambient pressure, the volume of ink in each of the reservoirs or the amount of filter blockages. A single motor and a multi-head pump are also provided to the system. Further, the system comprises a heating means, a cooling means and thermal sensing means for each printhead to enable maintenance of the ink temperature in each of the printheads independent of the image (consequently ejection energy) content. In addition, the system includes an ink reservoir utilizing an ink filter and an ink level sensing arrangement. In an alternative embodiment, the ink is delivered through the printhead by using a segmented manifold on the printhead so that multiple ink colors can be printed by a single printhead.

While this invention is particularly directed to the art of acoustic ink printing, and will thus be described with specific reference thereto, it will be appreciated that the invention may have usefulness in other fields and applications. For example, the invention may have application with any type of printhead where a uniform, constant, high speed flow of ink is utilized, to cool/maintain the temperature of the printhead while the ink pressure is maintained/kept uniform for uniform printing. The invention may also find application in fields where materials other than ink are emitted from an acoustic emitter.

BACKGROUND

By way of background, it has been shown that acoustic ink printers which have printheads comprising acoustically illuminated spherical or Fresnel focusing lenses serving as droplet emitters can print precisely positioned picture elements (pixels) at resolutions that are sufficient for high quality printing of complex images. Significant effort has gone into developing acoustic ink printing, see for example, U.S. Pat. Nos. 4,308,547; 4,697,195; 4,751,530; 4,751,534; 5,028,937; and 5,041,849, all of which are among many commonly assigned to the present assignee.

Although acoustic lens-type droplet emitters currently are favored, there are other types of droplet emitters which may be utilized for acoustic ink printing, including (1) piezoelectric shell transducers, such as described in Lovelady et al., U.S. Pat. No. 4,308,547, and (2) interdigitated transducers (IDTs), such as described in commonly assigned U.S. Pat. No. 4,697,195. Furthermore, acoustic ink printing technology is compatible with various printhead configurations including (1) single emitter embodiments for raster scan printing, (2) matrix configured arrays for matrix printing, and (3) several different types of page and width arrays, ranging from (i) single row sparse arrays for hybrid forms of parallel/serial printing, (ii) multiple row staggered arrays with individual emitters for each of the pixel positions or addresses within a page width address field (i.e., single emitter/pixel/line) for ordinary line printing.

For performing acoustic ink printing with any of the aforementioned droplet emitters, each of the emitters launches a converging acoustic beam into a pool of ink, with the angular convergence of the beam being selected so that it comes to focus at or near the free surface (i.e., the liquid/air interface), or meniscus, of the pool. Moreover, controls are provided for modulating the radiation pressure which each beam exerts against the free surface of the ink. That permits the radiation pressure from each beam to make brief, controlled excursions to a sufficiently high pressure level to overcome the restraining force of surface tension, whereby individual droplets of ink are emitted from the free surface of the ink on command, with sufficient velocity to deposit them on a nearby recording medium.

Maintenance of pressure in the acoustic ink printhead relative to the meniscus is an important factor in maintaining uniform print quality. The position of the meniscus in the opening, or orifice, provided for emission of ink is required to be held constant so that the focussed beam consistently converges at or near the surface of the pool. Further, the temperature of the ink in the printhead should be prevented from increasing or decreasing in order to maintain the physical properties of the ink important for correct ejecting.

A main attraction of acoustic ink printing is the ability to control droplet size based on the frequency of the signal provided, rather than relying on the size of the nozzle emitting the droplet. For example, an AIP printer may emit droplets that are a magnitude in size smaller than the AIP openings. On the other hand, conventional ink jet printing requires a minimization of the nozzle itself to obtain small droplets.

It is desirable in an acoustic ink printing system to have a suitable ink delivery system. Specifically, the ink delivery system should deliver ink to the printheads of the printer at uniform, pulseless high flow rates. The reason for these requirements is that, as alluded to above, the process of printing using an acoustic ink printing system is very precise. Therefore, the flow rate to the printheads must be uniform and pulseless to avoid degradation in the process.

In addition, it is desirable in an acoustic ink printing system to maintain the pressure and temperature in the printhead at a uniform level because maintaining the meniscus of the ink in the openings noted above is very important to acceptable operation of the system. Known approaches to maintaining the pressure include controlling the voltage of the motor that drives the pump heads that pump the ink and providing feedback from pressure sensors attached to the ink line. However, these approaches require the use of regulators and sensors to maintain pressure. It would be desirable to avoid the use of such extraneous components in spite of changing environments and varying amounts of ink in the circuit, as well as small increases in resistance in the ink filter and the heat exchanger over the life of the printer.

Further, it is desirable, for certain applications, to address difficulties noted above and deliver multiple colors of ink to a single printhead.

Thus, the present invention contemplates a new ink delivery system that finds particular application-with acoustic ink printheads and overcomes the heretofore known difficulties.

SUMMARY OF THE INVENTION

An ink delivery system for use with an acoustic ink printer having incorporated therein at least one acoustic ink printhead from which ink is emitted is provided. The invention is directed to a relatively compact, sealless system that provides high speed, pulseless and uniform flows of ink maintained at constant temperature and pressure through the acoustic ink printheads, which is robust over external conditions.

In one aspect of the invention, the system comprises a motor having a drive gear/pulley, an ink reservoir having a bottom portion with a first passageway defined therein, the reservoir also having a heater and a filter disposed therein, a pump head having disposed therein first and second pump gears positioned for operative engagement with one another to drive ink received from the ink reservoir through the first passageway out of the pump head through an outlet, a drive shaft extending from the first pump gear through a second passageway of the ink reservoir and through the ink reservoir to a shaft gear/pulley operatively engaged to the drive gear, a heat exchanger optionally positioned to receive ink driven out of the pump head through the outlet, an inlet line from the heat exchanger to the printhead inlet and a return line from the printhead outlet back to the ink reservoir, the return line having an exit end open to the ambient, and a funnel-like structure attached to a manifold plate positioned on top of the ink reservoir that receives the returning ink and returns it to the ink reservoir through internal passages in the manifold plate.

In another aspect of the invention, the position of the exit end of the return line is adjustable relative to the ink orifice plane of the printhead.

In another aspect of the invention, the exit end of the return line is exposed to ambient pressure.

In another aspect of the invention, the heater and heat-exchanger is selectively operated.

In another aspect of the invention, the filter is a pleated filter that defines a substantially exterior region of the reservoir into which the return ink is delivered, thereby the return ink travels through the pleated filters into a sealed inner region of filtered ink which is connected to the inlet port of the pump.

In another aspect of the invention, a segmented manifold is provided to each printhead of the system to allow for delivery of multiple colors of ink to a single printhead.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, and combination of the various parts of the device and steps of the method, whereby the objects contemplated are attained as hereinafter more fully set forth, specifically pointed out in the claims, and illustrated in the accompanying drawings in which:

FIGS. 6(*a*) and (*b*) show an elevational view and a cross-sectional view of an alternative embodiment of the ink reservoir and pump assembly; and, FIGS. 7(*a*) and (*b*) show alternative embodiments of an optional segmented manifold for delivery of ink to an acoustic ink printhead according to the present invention.

DETAILED DESCRIPTION OF THE PREFERRED EMBODIMENTS

Figure 1:
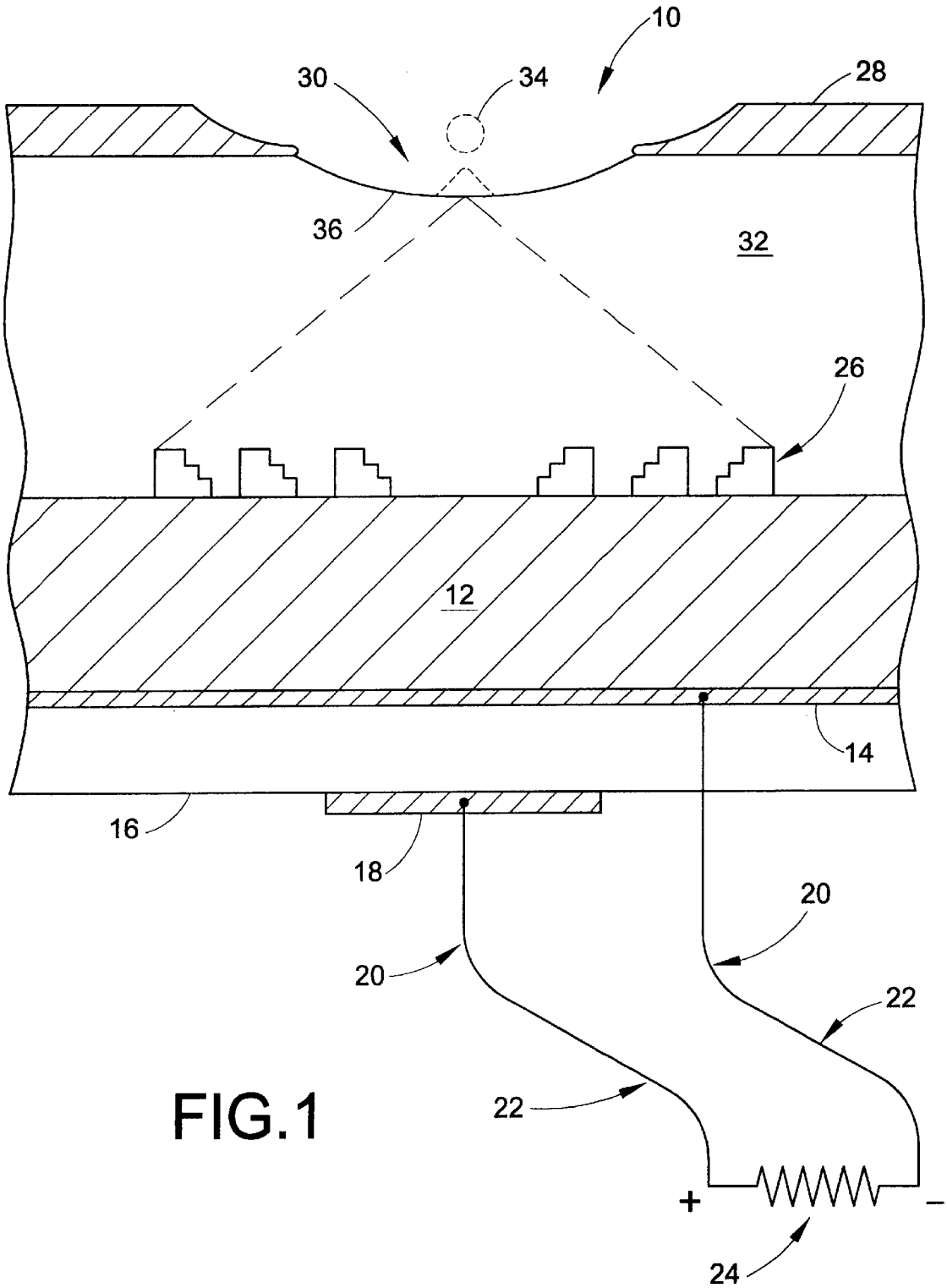
FIG. 1 is a graphic representation of the basic operation of an acoustic ink printing element.

FIG. 1 provides a view of an exemplary acoustic ink printing ejector 10 to which the present invention is directed. Of course, other configurations may also have the present invention applied thereto. Additionally, while a single ejector is illustrated, an acoustic ink printhead will consist of a number of the ejectors arranged in an array configuration, and the present invention is intended to work with such an array. Moreover, the embodiments herein are described in connection with applications involving emission of ink by a printhead; however, it is to be appreciated that materials other than ink may be emitted by the head and that, consequently, aspects of the present invention may be applied in such applications as is appropriate.

As shown, ejector 10 includes a glass layer 12 having an electrode 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown by lines 20 and 22 to a radio frequency (RF) power source 24 which generates power that is transferred to the electrodes 14 and 18. On a side opposite the electrode layer 14, a lens 26, such as a concentric Fresnel lens, or other appropriate lens, is formed. Spaced from the lens 26 is a liquid level control plate (also called an orifice plate) 28, having an opening or orifice 30 formed therein. Fluid, or ink, 32 is retained between the orifice plate 28 and the glass layer 12. The orifice 30 is aligned with the lens 26 to facilitate emission of a droplet 34 from ink surface, or meniscus, 36. Ink surface 36 is, of course, exposed by the orifice 30.

The lens 26, the electrode layer 14, the piezoelectric layer 16 and the electrode 28 are formed on the glass layer 12 through photolithographic techniques. The orifice plate 28 is subsequently positioned to be spaced from the glass layer 12. The ink 32 is fed into the space between the orifice plate 28 and the glass layer 12 from an ink supply.

Figure 2:
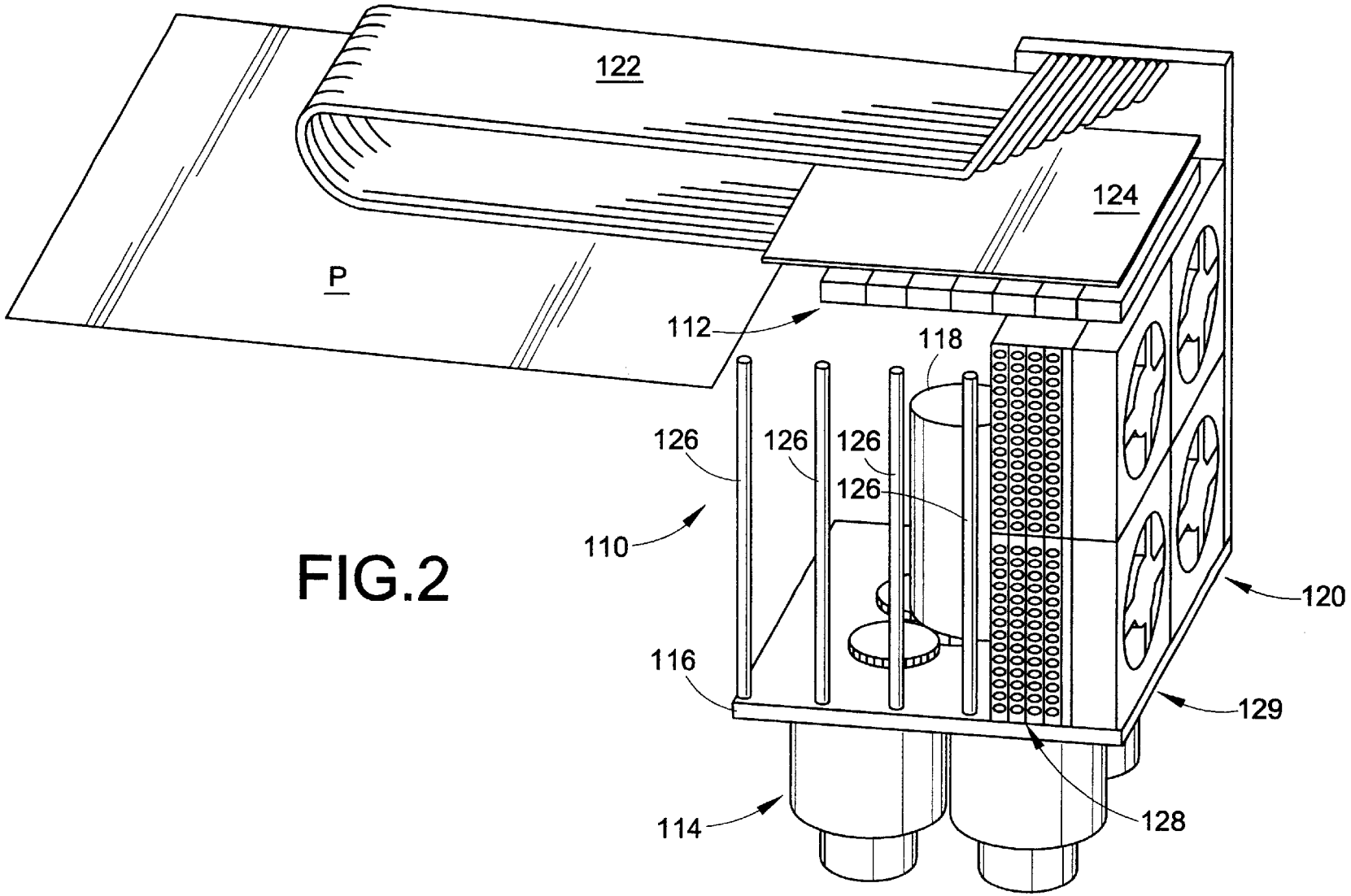
FIG. 2 is a perspective view of the ink delivery system of the present invention.

The present invention contemplates vast improvements over known systems with respect to the delivery of ink from the ink supply to the printhead (and its emitters) and the continuous recirculating of the ink at flow rates approximately twenty times the maximum ejection rate of all the ejectors during the course of printing. In this regard, FIG. 2 provides a partial view of an acoustic ink printing system. It is to be appreciated that the apparatus shown may be incorporated in an acoustic ink printer in a variety of manners depending on the configuration of the printer. In this regard, for example, the relative positions of components may be changed to accommodate a particular printer and still fall within the scope of the invention.

As shown, an ink delivery apparatus 110 is shown in a relative relationship to a piece of paper P upon which the printheads 112 of an acoustic ink printer (not shown in its entirety) will emit droplets of ink. The apparatus 110 includes reservoir and pump assemblies 114, a reservoir manifold 116, a motor 118, and a heat exchanger assembly 120. Ink lines 122 are also provided. A first set of ink lines 122 are operatively coupled to the heat exchanger assembly 120 to carry ink from the heat exchanger assembly to the printheads 112 positioned on the printer carriage 124. A second set of ink lines 122 serve as return lines 134 (shown in FIG. 3) for ink delivered to the printheads enabling the continuous recycling of the ink.

The motor 118 is preferably a DC reversible motor (approximately 1.5 watts). The motor also preferably has an appropriate drive mechanism in the form of a gear or pulley arrangement to drive a plurality of pump heads. Both a gear arrangement and a pulley arrangement have advantages but it is to be appreciated that in applications where certain tolerances and/or flexibility are desired, the pulley arrangement is preferred. The showings in the drawings illustrate a gear arrangement; however, it will be appreciated by those skilled in the art that similar such structure will, with modification, facilitate a pulley arrangement.

With continuing reference to FIG. 2, the heat exchange assembly comprises the heat exchanger 128 which is formed with coiled or bent thin-walled stainless steel tubing. It is to be appreciated that there is a single heat exchanger provided for each color of ink. The heat exchange assembly also includes a plurality of fans 129. Again, one fan is provided per color of ink. Preferably, the fans are driven by direct current.

It is to be appreciated that, in general, the ink is delivered from the reservoir and pump assemblies 114 through the heat exchanger assembly 120 and the first set of ink lines 122 to the printheads 112. The printheads are selectively moved back and forth across the paper P according to print commands from the printer in order to print an image on the paper P. The ink lines 122, of course, must be of sufficient flexibility to bend as the carriage moves across the paper. Return ink is then recirculated to the reservoir and pump assemblies by way of the second set or return lines 134 within the group of lines 122.

Figure 3:
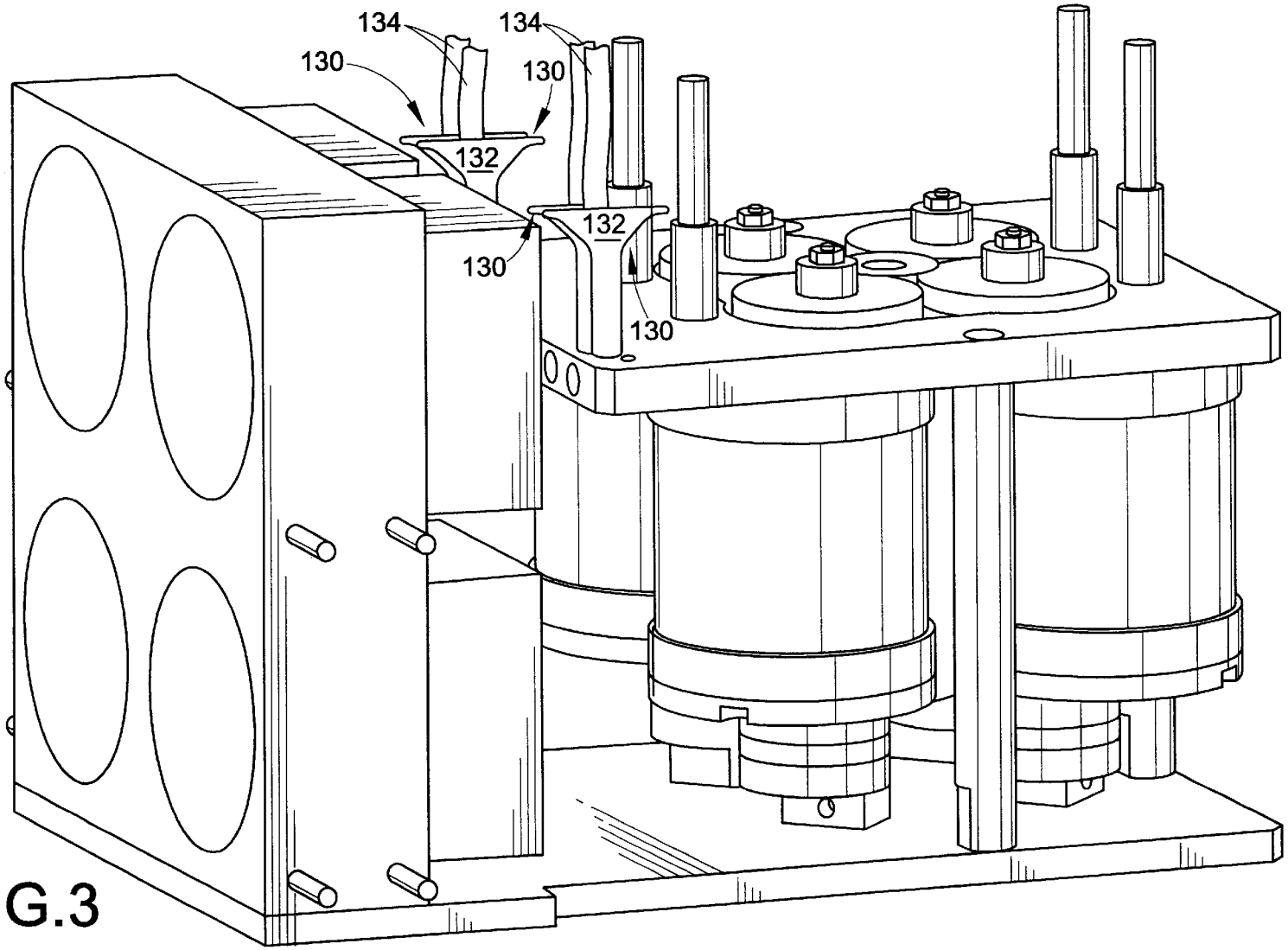
FIG. 3 is a perspective view of a portion of another embodiment of the ink delivery system of the present invention.

Referring now to FIG. 3, a modified ink delivery system is shown wherein the motor 118 is moved to be positioned between the four reservoirs and pump assemblies 114, as opposed to being positioned above such assemblies. Also illustrated in FIG. 3 are ink return ducts 130 (not viewable in FIG. 2) having conical funnel-shaped portions 132 that receive the ends of ink return lines, which are included within the lines 122. Otherwise, the assembly shown in FIGS. 2 and 3 are substantially similar.

Figure 4A:
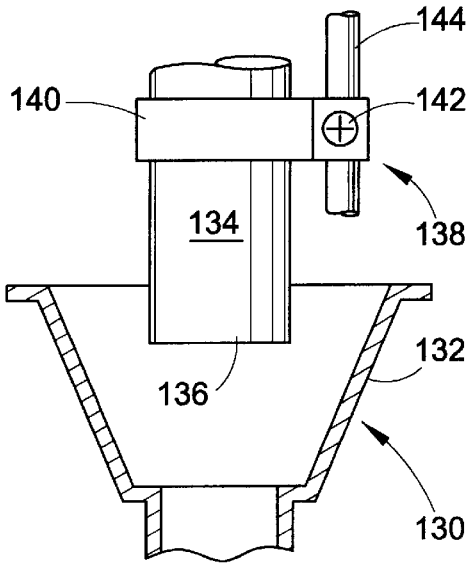
FIGS. 4(*a*) and (*b*) show views of exemplary ink return ducts according to the present invention.
Figure 4B:
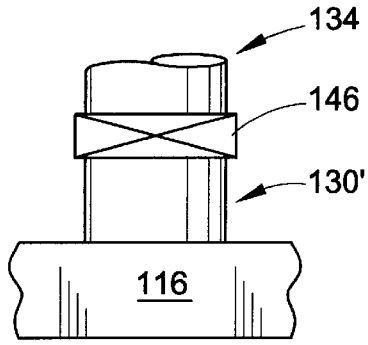

With specific reference now to FIG. 4(*a*), the ink return duct 130 is illustrated in cross-section. As shown, a conical section 132 receives an exit end 136 of the return line 134. It is to be recognized that the end 136 opens to ambient pressure and does not make direct connection to the duct 130. Also illustrated in FIG. 4 is a position adjustment mechanism 138 to adjust the relative positions of return line 134 with respect to the stationary ink receiver 130. The position adjustment mechanism 138 preferably takes the form of a collar 140 and an adjustable set-screw 142 that are positioned and locked in any suitable location within the printer (e.g. disposed on frame or post 144) to fix and selectively adjust the location of the return line 134 relative to the orifice plane of the printhead. Of course, any appropriate mechanism apparent to those of skill in the art for accomplishing this task will suffice.

The operational advantage of the ink return exit 136 and its interaction with the position adjustment mechanism 138 is that it allows the pressure in the acoustic ink printhead to be maintained. As noted above, this is an important feature in an acoustic ink printer. In the present invention, the return line, which comprises simple flexible tubing that is commercially available, is positioned between the printhead and the receiving duct 130. Because the return line opens to ambient pressure at its end 136, the pressure on the printhead is determined only by the difference in height from the printhead to the location at which the return line opens to ambient pressure and the flow rate in the tube. Importantly, the pressure in the acoustic ink printhead is divorced from any ink level change within the reservoir, ink buildup in the filters, and any buildup or degradation in the heat exchange assembly, all of which are upstream of the printhead.

To maintain the desired absolute pressure in the printhead and thus maintain position of the meniscus relative to the orifice plate in the printhead, the resistance of the tubing from the printhead to the return reservoir should be considered. As such, the system requires calibration because the flow rate in the return tubes may vary from one color to another. Any slight variation may consequently effect the meniscus position within the printhead.

One approach to maintaining the desired pressure in each printhead is to use four separate valves (as will be described in connection with FIG. 4(*b*)). However, in the preferred embodiment, the pressure in each printhead is set by adjusting the height of the return line as it opens up to ambient pressure above the conical shaped return ink duct. In the preferred embodiment, approximately one inch of tube adjustment corresponds to three microns of adjustment in the meniscus.

With respect to the valve arrangement noted above, FIG. 4(*b*) shows an ink return duct 130' having associated therewith a selectively actuatable valve 146 disposed between the duct 130' and the return line 134. The valve may take any suitable form. Moreover, it is to be appreciated that a valve is provided to each return line, although only a single valve/return line is shown.

Figure 5:
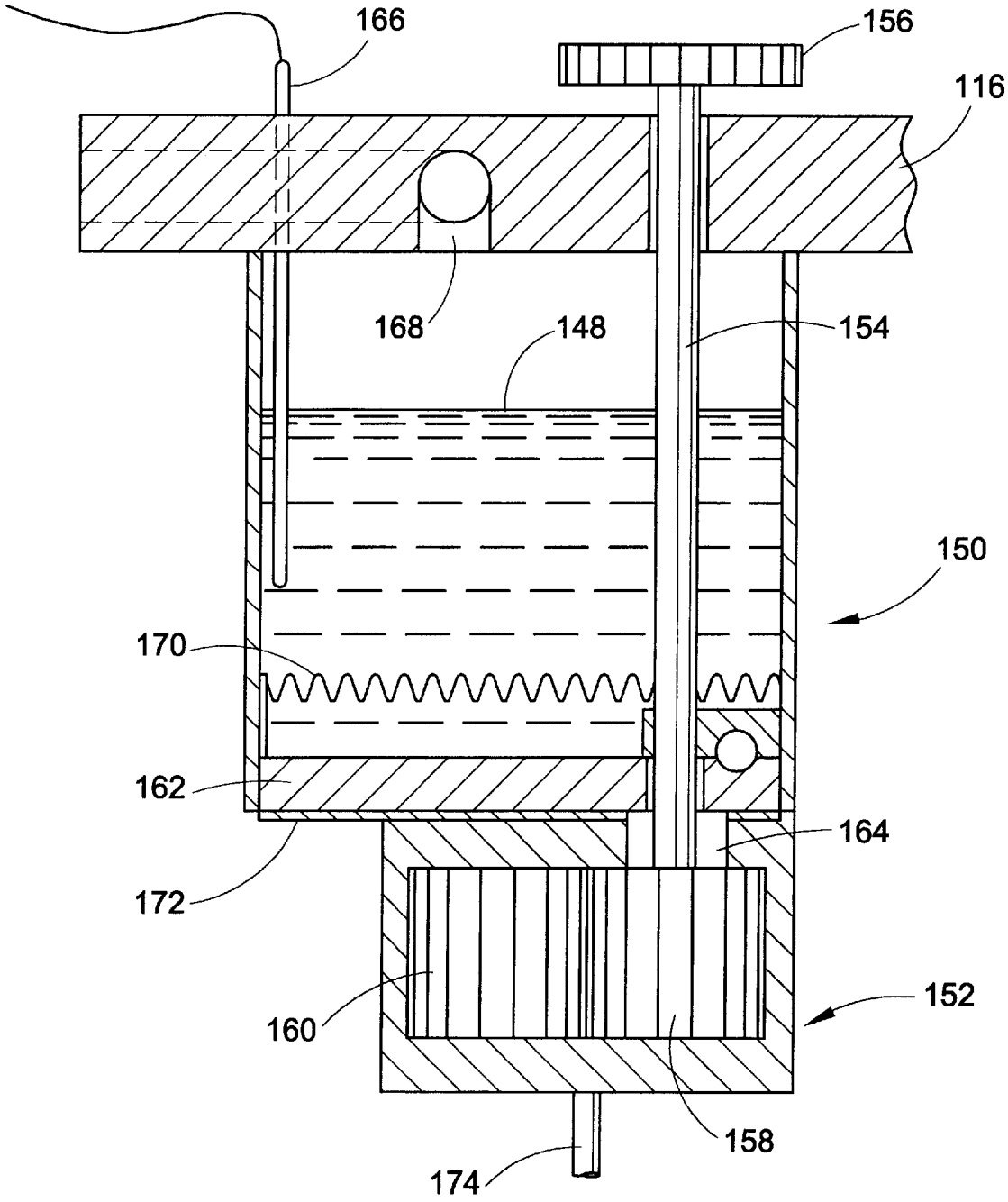
FIG. 5 is a cross-sectional view of the manifold plate and the reservoir and pump assembly according to the present invention.

Referring now to FIG. 5, an ink reservoir and pump assembly 114 is shown. Specifically, ink 148 is stored within ink reservoir 150. Ink reservoir 150 has attached thereto a pump head 152 for pumping ink into the heat exchanger. Preferably, the pump head is a helical gear type head.

As shown, drive shaft 154 has disposed, at one end, a shaft gear/pulley 156 that engages the drive mechanism of the motor. At an opposite end of the shaft is pump drive gear 158 that engages pump driven gear 160 to drive ink out of the head through outlet 174. As illustrated, the bottom portion 162 of the reservoir includes therein a passage way 164 through which the drive shaft extends.

Also shown in FIG. 5 is a level sensing device 166 that is used to detect the level of the ink within the reservoir and a return path 168 that communicates through the manifold to the ink return duct 130 described in connection with FIGS. 3 and 4. The level sensing device 166 may take a variety of forms including, but not limited to, a device operating based on electrical conduction, electrical capacitance, frequency vibration, and/or optical path length.

The ink reservoir further includes a filter 170 and a heater 172. The filter, while representatively shown, may take a variety of forms, one of which will be described hereafter. The heater is selectively operated to heat the ink according to predetermined criteria. An outlet tube 174 is also shown that provides a passage way from the pump head to the heat exchanger assembly 120. The heat exchange assembly is also selectively operated according to predetermined criteria. For example, the heater is used to heat the ink to the desired operating temperature during the initiation of printing. However, once the printer has printed for a period of time, the ink may require cooling through the heat exchange assembly.

FIG. 6(*a*) is an elevational view of a modified but preferred reservoir and pump assembly according to the present invention. FIG. 6(*b*) provides a cross-sectional view thereof. Specifically, the ink reservoir 150 has included therein a filter 170' that takes the form of a pleated cylinder with substantially cylindrical recesses formed therein and which defines a substantially exterior, or outer, region 176 of the reservoir into which the return ink is delivered, thereby the return ink travels through the pleated filters into a sealed inner region 178 of filtered ink which is connected to the inlet port of the pump. As shown, the filter extends through the entire height of the reservoir. Also shown is a drive shaft collar 180.

It should be noted that the preferred assembly also includes a Teflon sleeve bearing ring 182 and Teflon sleeve bearing rings 184 that are positioned to accommodate rotation of the drive shaft 154 in the pump head 152. Also shown are a junction seal 186 positioned between the pump head and the ink reservoir. The junction seal prevents ink leakage at the junction of the reservoir and the pump head. It is to be appreciated that the junction seal is only desireable because, as shown, the reservoir and pump head are separate parts. The junction seal would be unnecessary if the reservoir and pump head were unitary or practically unitary through use of gluing or welding techniques.

Significantly, a port 190 is also illustrated in FIG. 6(*b*). It is to be appreciated that similar ports are present in the apparatus shown in FIG. 5, although it is not viewable in the selected cross-section. The port 190 provides a passageway between the reservoir 150 and the pump head 152.

In one embodiment, the reservoir is formed of anodized aluminum and the drive shaft 180 is formed of stainless steel. Further, the heater is preferably a silicon heater (80 watts and 24 volts).

The description thus far has focussed on the delivery of ink to the emitters of acoustic ink printheads wherein each of the printheads print only one color of ink at a time. In such a configuration, there is a manifold provided to each printhead. With reference to the previously described embodiments, the manifold of each printhead serves as an ingress area for the ink supplied by the ink supply lines as well as an egress area for facilitating the recirculation of ink through the return lines.

Figure 7A:
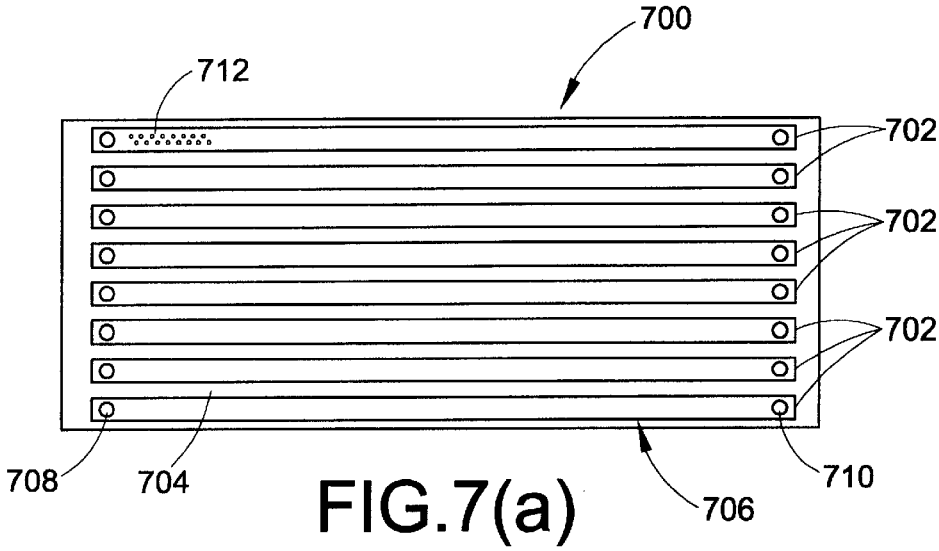
Figure 7B:
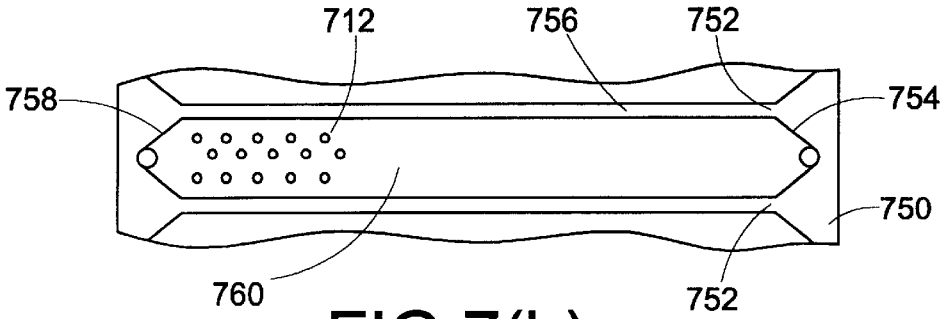

As an option, therefore, a segmented manifold selectively taking the form of the examples illustrated in FIGS. 7(*a*) and (*b*)—to allow more than one color of ink to be pumped through the same printhead over the emitters—is provided to the ink delivery system of the present invention. It should be recognized that the advantages and features of the system described thus far are also applicable to these embodiments, with suitable modifications to accommodate the segmented manifold.

As shown in FIG. 7(*a*), a representative view of a portion of an acoustic ink printhead (with, for example, a cover plate removed) illustrates a segmented manifold 700 to effectively partition the emission face of the printhead to accommodate multiple colors of ink. The manifold 700 has ink chambers 702 defined by partition walls, one of which is identified by 704, that extend across an opening 706. Each ink chamber 702 includes an inlet port, one of which is identified by 708, and an outlet port, one of which is identified by 710. It is to be appreciated that the inlet port communicates with one of the first set of ink lines 122 (FIG. 2) and the outlet port communicates with the return lines 134 of the second set of ink lines 122 (FIGS. 2 and 3). The emitters, only a few of which are representatively shown at 712, are disposed across the entirety of the chambers 702 at suitable locations to effect ink emission.

Of course, because only a single printhead is needed for the variety of colors accommodated by embodiments previously described, suitable changes that will be apparent to those skilled in the art may be necessary to facilitate connection of the multiple ink reservoirs (and, consequently, ink lines) to the single printhead. It should be further appreciated that the segmented manifold is not limited to use in only the embodiments described herein.

Referring now to FIG. 7(*b*), a portion of a similar segmented manifold 750 is shown. The primary difference between the manifolds of FIGS. 7(*a*) and (*b*) is that the partition walls 752 comprise a plurality of portions disposed at angles to one another. For example, portions 754, 756 and 758 serve to partition an ink chamber 760 from other chambers. It should also be appreciated that the angles of the partition walls accommodate a fanning of the ink as it is drawn into the chamber and delivered across emitters.

It will be recognized that the precise configuration of the manifold will largely depend on the configuration of the printhead—which may vary from application to application. For example, the angled partition walls described in connection with FIG. 7(*b*) may reside on a surface of the printhead that is perpendicular to the surface from which ink is emitted. In any configuration, however, the primary features of a segmented manifold according to the present invention are the partition walls that define chambers into which colored inks can be supplied to allow a single printhead to print multiple colors of ink. Such segmentation may require certain modifications to a printing system; however, a segmented manifold according to the present invention results in a variety of advantages which will be described below.

It should also be understood that, in either configuration described above, each chamber is positioned to correspond to a predetermined group of emitters. As such, any scheme to address these emitters should take this into account. In this regard, the addressing scheme of a printhead dedicated to only a single color is modifiable to allow, for example, the printing system to recognize that emitter #1 will emit cyan ink while emitter #250 will emit magenta ink. The modification will be apparent to those skilled in the art upon a reading of this description given the fact that the addressing scheme for a plurality of single color printheads already distinguishes between different printheads. In this regard, the individual color data could be integrated into a single-head data format.

An advantage to the segmented manifold of the present invention is that color-to-color registration is relatively precise because the emitter, or ejector, components for all colors are on the same, uncut glass. Accurate color registration, therefore, is independent of multiple-head misalignment and non-uniformities. Problems and errors associated with the head-to-head mechanical adjustment are also eliminated.

Another advantage to the segmented manifold is that it is more practical to customize the RF frequency chirp specifically for the single printhead. Presently, when multiple printheads are used, it is possible to establish a unique optimized center frequency for each head; however, necessary operating power and electronics cost is increased by doing so. As such, tuning the electronics to optimize chirp on a single multi-color printhead results in minimized operating power and reduced cost.

Although use of only a single multicolor printhead is preferred in many applications, another advantage of using a segmented manifold as contemplated herein is that a plurality of multicolor printheads could be aligned to optimize certain color printing applications. For example, if n multicolor printheads—each segmented to print n different colors—are aligned in such a manner so that segmented portions corresponding to a common color of adjacent printheads are staggered, single pass printing can be accomplished for a length of printing medium equaling the length of a printhead. If only a single multicolor printhead is used, multiple passes must be used. This arrangement provides particular advantages where only multicolor printheads are available. As a further example, multiple printheads could be used whereby adjacent printheads emit different droplet sizes.

Wider printheads result in faster speed; however, a printhead width could nonetheless be divided into many sections (e.g. 8 sections) and still result in a competitive printing speed, with much higher color resolution as a result of the advantages noted above. As acoustic ink printhead technology grows to produce wider heads, this technique would provide the opportunity to add many-more ink colors, and do it elegantly with just one printhead. The choice of which color to circulate through each segment can be completely customizable. For instance, one choice might be to use 5 segments for black ink, and 3 segments for the primary colors, while another might be to use 8 different colors.

Also, specialized spot color printing would be possible by selecting a specialty ink such as translucent or light scattering material. This could allow a 'high-fi color' printing capability without the costs associated with using many single-color printheads.

As color requirements change, the inks can easily be rinsed out and replaced with a new custom set. The product set could be enhanced by options to include more than one multi-color printhead (which allows for more colors than the number of printheads for which space is available in the printer), complete with ink and electronics support, to keep the customer up-and-running with multiple custom configurations. As described above, multiple multi-color printheads could be added to increase output speed.

The above description merely provides a disclosure of particular embodiments of the invention and is not intended for the purpose of limiting the same thereto. As such, the invention is not limited to only the above described embodiments. Rather, it is recognized that one skilled in the art could conceive alternative embodiments that fall from the scope of the invention.

Having thus described the invention, we hereby claim:

1. An ink delivery system for use with an acoustic ink printer having incorporated therein at least one acoustic ink printhead from which ink is emitted, the system comprising:

a motor having a drive gear;

an ink reservoir having a bottom portion with a first passageway defined therein, the reservoir also having a heater and a filter disposed therein;

a pump head having disposed therein first and second pump gears positioned for operative engagement with one another to drive ink received from the ink reservoir through the first passageway out of the pump head through an outlet;

a drive shaft extending from the first pump gear through a second passageway of the ink reservoir and through the ink reservoir to a shaft gear operatively engaged to the drive gear;

a selectively operated heat exchanger positioned to receive ink driven out of the pump head for selectively cooling the ink to a desired temperature;

an inlet line connecting the heat exchanger to the ink inlet of the printhead;

a return line from the printhead to the ink reservoir, the return line having a first end positioned to receive ink from the printhead and a second exit end;

a manifold plate positioned on the ink reservoir; and, an ink duct disposed on the manifold plate, the ink duct being positioned to receive ink from the second exit end of the return line such that received ink returns to the ink reservoir through the manifold plate.

2. The system as set forth in claim 1 wherein the heater is selectively operated.

3. The system as set forth in claim 1 wherein a height of the second exit end of the return line is adjustable relative to an ink meniscus plane of the printhead for maintaining a desired pressure in the printhead.

4. The system as set forth in claim 3 wherein the second exit end of the return line is exposed to ambient pressure.

5. The system as set forth in claim 1 further comprising a segmented manifold provided to the printhead.

6. An ink delivery-system for use with an acoustic ink printer having incorporated therein at least one acoustic ink printhead from which ink is emitted, the system comprising:

a motor having a drive gear;

an ink reservoir having a bottom portion with a first passageway defined therein, the reservoir also having a heater and a filter disposed therein, wherein the filter is substantially a pleated cylinder and has defined therein a first substantially inner cylindrical sealed region in which the filtered ink is collected and ported into the pump-head, and an outer region where the return ink enters the reservoir and collects;

a pump head having disposed therein first and second pump gears positioned for operative engagement with one another to drive ink received from the ink reservoir through the first passageway out of the pump head through an outlet;

a drive shaft extending from the first pump gear through a second passageway of the ink reservoir and through the ink reservoir to a shaft gear operatively engaged to the drive gear;

a selectively operated heat exchanger positioned to receive ink driven out of the pump head for selectively cooling the ink to a desired temperature;

an inlet line connecting the heat exchanger to the ink inlet of the printhead;

a return line from the printhead to the ink reservoir, the return line having a first end positioned to receive ink from the printhead and a second exit end;

a manifold plate positioned on the ink reservoir; and, an ink duct disposed on the manifold plate, the ink duct being positioned to receive ink from the second exit end of the return line such that received ink returns to the ink reservoir through the manifold plate.

7. An ink delivery system for use with an acoustic ink printer having incorporated therein a plurality of acoustic ink printheads from which ink is emitted, the system comprising:

a motor having a drive gear/pulley;

a plurality of ink reservoirs corresponding to the plurality of printheads whereby a single printhead draws ink from a single reservoir, each reservoir having a bottom portion with a first passageway defined therein and a heater and a filter and a level-sensor disposed therein;

a plurality of pump heads provided to the plurality of ink reservoirs whereby a single pump head is connected to a single reservoir, each pump head having disposed therein first and second pump gears positioned for operative engagement with one another to drive ink received from a corresponding ink reservoir through the first passageway out of the pump head through an outlet;

a selectively operated heat exchanger positioned to receive ink driven out of the pump heads for selectively cooling the ink to a desired temperature; and a plurality of drive shafts, each drive shaft extending from the first pump gear of a corresponding pump head through a second passageway of a corresponding ink reservoir and through the ink reservoir to a shaft gear/pulley operatively engaged to the motor drive.

8. The system as set forth in claim 7 further comprising return lines from the printheads to the ink reservoirs, each return line having a first end positioned to receive ink from the printhead and a second exit end, a manifold plate positioned on the ink reservoirs, and a plurality of ink ducts corresponding to the ink reservoirs disposed on the manifold plate, the plurality of ink ducts being positioned to receive ink from the second exit ends of the return lines such that received ink returns to a corresponding ink reservoir through the manifold plate.

9. The system as set forth in claim 8 wherein a height of the second exit end of the return line is adjustable relative to an ink meniscus plane of the printheads for maintaining a desired pressure in the printheads.

10. The system as set forth in claim 9 wherein the second end of the return line is exposed to ambient pressure.

11. The system as set forth in claim 7 wherein the heater is selectively operated.

12. An ink delivery system for use with an acoustic ink printer having incorporated therein a plurality of acoustic ink printheads from which ink is emitted, the system comprising:

a motor having a drive gear/pulley;

a plurality of ink reservoirs corresponding to the plurality of printheads whereby a single printhead draws ink from a single reservoir, each reservoir having a bottom portion with a first passageway defined therein, and a heater, a filter and a level-sensor disposed therein, wherein the filter is substantially a pleated cylinder and has defined therein a first substantially inner cylindrical sealed region in which the filtered ink is collected and ported into the pump-head, and an outer region where the return ink enters the reservoir and collects;

a plurality of pump heads provided to the plurality of ink reservoirs whereby a single pump head is connected to a single reservoir, each pump head having disposed therein first and second pump gears positioned for operative engagement with one another to drive ink received from a corresponding ink reservoir through the first passageway out of the pump head through an outlet;

a selectively operated heat exchanger positioned to receive ink driven out of the pump heads for selectively cooling the ink to a desired temperature; and a plurality of drive shafts,. each drive shaft extending from the first pump gear of a corresponding pump head through a second passageway of a corresponding ink reservoir and through the ink reservoir to a shaft gear/pulley operatively engaged to the motor drive.

13. An ink delivery system for use with an acoustic ink printer having incorporated therein a plurality of acoustic ink printheads from which ink is emitted, the system comprising:

a motor having a drive gear/pulley;

a plurality of ink reservoirs corresponding to the plurality of printheads whereby a single printhead draws ink from a single reservoir, each reservoir having a bottom portion with a first passageway defined therein, and a heater, a filter and a level-sensor disposed therein, wherein the filter is substantially a pleated cylinder and has defined therein a first substantially inner cylindrical sealed region in which the filtered ink is collected and ported into the pump-head, and an outer region where the return ink enters the reservoir and collects;

a plurality of pump heads provided to the plurality of ink reservoirs whereby a single pump head is connected to a single reservoir, each pump head having disposed therein first and second pump gears positioned for operative engagement with one another to drive ink received from a corresponding ink reservoir through the first passageway out of the pump head through an outlet where the pressure in each printhead is adjusted by a valve in each return line;

a selectively operated heat exchanger positioned to receive ink driven out of the pump heads for selectively cooling the ink to a desired temperature; and a plurality of drive shafts, each drive shaft extending from the first pump gear of a corresponding pump head through a second passageway of a corresponding ink reservoir and through the ink reservoir to a shaft gear/pulley operatively engaged to the motor drive.

14. An ink delivery system for use with an acoustic ink printer having incorporated therein at least one acoustic ink printhead from which ink is emitted, the system comprising:

means for storing ink having a bottom portion with a first passageway defined therein, the storing means also having a means for heating the ink and a means for filtering the ink disposed therein;

means for pumping the ink received from the ink storing means through the first passageway out of the pump means through an outlet;

means for selectively cooling the ink received through the outlet to a desired temperature;

means for driving the pumping means extending from the pumping means through a second passageway of the storing means and through the storing means to a motor; and means for returning ink from the printhead to the storing means.

15. The system as set forth in claim 14 wherein the pumping means comprises a pair of pump gears positioned for operative engagement with one another.

16. The system as set forth in claim 14 wherein the ink returning means includes a return line having a first end positioned to receive ink from the printhead and a second exit end, a manifold plate positioned on the ink storing means, and an ink duct disposed on the manifold plate, the ink duct being positioned to receive ink from the second exit end of the return line such that received ink returns to the ink storing means through the manifold plate.

17. The system as set forth in claim 14 further comprising a segmented manifold provided to the printhead to accommodate multiple colors of ink.

* * * * *